US005133647A

United States Patent [19]

Herron et al.

[11] Patent Number: 5,133,647

[45] Date of Patent: * Jul. 28, 1992

[54] PULSE DAMPER

[75] Inventors: Ross W. Herron, Lathrop Village; Garry E. Beard, Livonia, both of Mich.

[73] Assignee: Ultra-Precision Manufacturing, Ltd., Birmingham, Mich.

[ * ] Notice: The portion of the term of this patent subsequent to Jun. 19, 2007 has been disclaimed.

[21] Appl. No.: 538,851

[22] Filed: Jun. 15, 1990

Related U.S. Application Data

[63] Continuation-in-part of Ser. No. 376,817, Jul. 7, 1989, Pat. No. 4,934,482.

[51] Int. Cl.[5] ..... F01N 1/08; F04B 39/00

[52] U.S. Cl. ..... 417/312; 181/224; 181/265; 181/268

[58] Field of Search ..... 417/312, 269; 181/224, 181/229, 237, 255, 265, 268, 269

[56] References Cited

U.S. PATENT DOCUMENTS

| | | | |
|---|---|---|---|
| 4,474,260 | 10/1984 | Valentine | 181/239 V |
| 4,679,597 | 7/1987 | Stein | 181/280 X |
| 4,790,727 | 12/1988 | Steele | 417/269 |
| 4,820,133 | 4/1989 | Steele et al. | 417/269 |
| 4,929,157 | 5/1990 | Steele et al. | 417/312 |
| 4,934,482 | 6/1990 | Herron et al. | 417/269 |

*Primary Examiner*—Leonard E. Smith
*Attorney, Agent, or Firm*—Dykema Gossett

[57] ABSTRACT

A pulsation damper is disclosed for use in a standard air-conditioning compressor for an automobile. The pulsation damper consists of a body portion and a cap portion and the cap portion has an outer diameter that is dimensioned to be press fit within the outlet opening of the housing of the air compressor. Thus, the pulsation damper can be retro-fit in a standard air compressor housing and will not increase the overall size of the housing or require modification in the connecting tubing. The body of the pulsation damper consists of longitudinal groove-like passages which direct the fluid flow from one of two internal compressor discharge lines to a point where it opposes and is intermixed with the fluid flow from another internal discharge line. This opposition and intermixing of the two fluid flow paths, which have pressure pulses which are out of synchronism with each other, tends to cancel or reduce such pulses. The fluid flow extends through a central passage formed in the body portion of the pulsation damper and then exits through a series of circumferentially spaced outlet ports formed in the cap. In further embodiments, the body and shoulder portion which retains the pulse damper in the compressor housing are integrally formed as a one piece cast item.

11 Claims, 3 Drawing Sheets

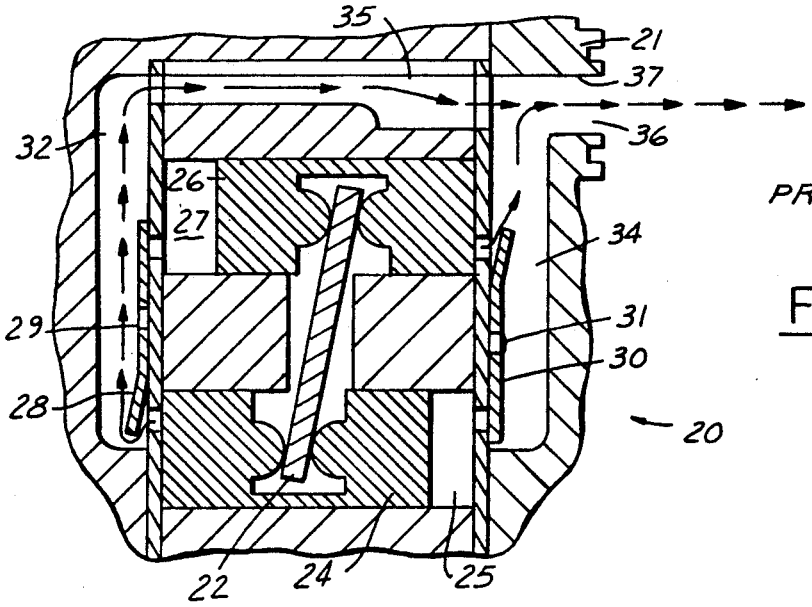
PRIOR ART
FIG. 1
PRIOR ART
FIG. 2
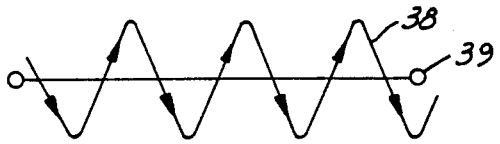
FIG. 3
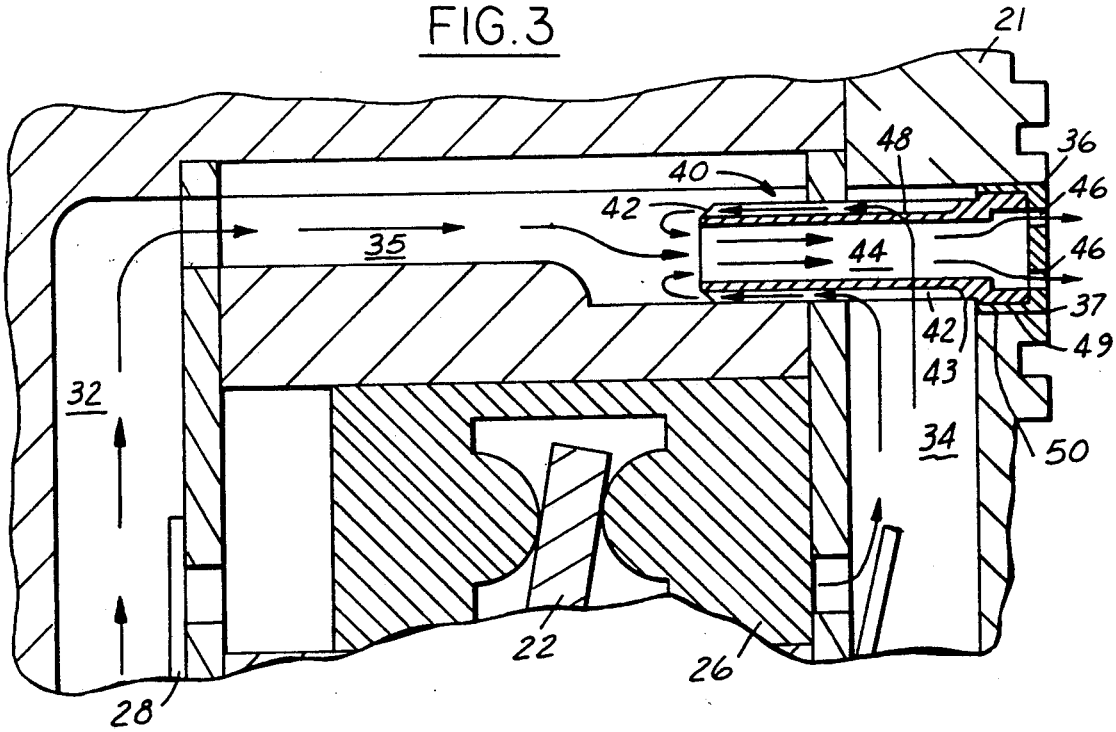

PULSE DAMPER

This is a continuation-in-part of copending application Ser. No. 07/376,817 filed on Jul. 7, 1989, now U.S. Pat. No. 4,934,482.

BACKGROUND OF THE INVENTION

This invention is directed to a pulsation damper for use in high pressure fluid systems. More particularly, it relates to a pulsation damper that will combine the flow from two separate high pressure fluid discharge lines associated with an air-conditioning system.

Pressure pulses are frequently encountered in high pressure fluid systems. As an example of a prior art high pressure fluid system, a compressor for use in air-conditioning system for an automobile is illustrated in FIG. 1. Compressor assembly 20 is mounted in housing 21 and has swash plate 22 that reciprocates two opposed pistons 24 and 26 in cylinders 25 and 27. Disc spring biased discharge valves 28 and 30 are pinned to a valve head within housing 21 at 29 and 31, respectively, and regulate the flow of pressurized refrigerant from cylinders 25 and 27. There may be three or more of the illustrated opposed piston arrangements spaced circumferentially about housing 21. As is well known, these three piston arrangements serially reciprocate out of phase from each other due to the swash plate 22.

Pistons 24 and 26 reciprocate to compress fluid within cylinders 25 and 27. When the fluid pressure reaches a predetermined value, the pressure within cylinders 25 and 27 will overcome the spring force of valves 28 and 30.

Compressor assembly 20, at the point illustrated in FIG. 1, has piston 24 discharging pressurized fluid from cylinder 25, through valve 28 and into a first discharge line 32. At the same time, piston 26 is discharging pressurized fluid from cylinder 27, through discharge valve 30 and into a second discharge line 34. A line 35 conducts fluid forwardly from first discharge line 32. An outlet 36 is disposed at a downstream end of both the first and second discharge lines 32 and 34 and receives fluid from both discharge lines. Outlet 36 is defined by an opening 37. A sealed connection conducts fluid from outlet 36 downstream in the air conditioning system.

Due to the reciporcating nature of this type of compressor, and the fact that valves 28 and 30 open only when a predetermined pressure is reached within cylinders 25 and 27, the resulting pressure at outlet 36 is seen as a series of pulses. As illustrated in FIG. 2, a pressure curve 38 for compressor assembly 20 has peaks and valleys that will result in undesirable drum-like noises during operation of the compressor assembly 20. The pressure curve 38 oscillates about a center line 39 that is the desired final pressure for the outlet 36. Each pulse, or oscillation, is associated with the discharge of one of the five opposed piston arrangements. Since the opposed pistons 24 and 26 may be both discharging at the same time, depending on the number of opposed piston arrangements used, the magnitude of the pulse may be increased.

In an idealized system, the pulses above and below the center line 39 would be eliminated and the pressure curve would approximate the center line 39. Various types of pulsation dampers have been employed to reduce the pulses within pressure curve 38. These prior art pulsation dampers have usually been relatively complex and expensive. They frequently require complicated attachments and housings.

The prior art pulsation dampers may be downstream of the compressor housing, connected by a hose to the compressor outlet and by a second hose to the condenser. Thus, these prior art pulsation dampers required four connection points. In high pressure system it is preferable to have as few connection points as possible.

In addition, the prior art pulsation dampers located downstream from the compressor assembly housing 21 add to the overall size of the system. It is a consideration in the design of any modern automobile system that all the components be as physically small as possible to make the most optimal use of available space.

U.S. Pat. Nos. 4,790,727 and 4,820,133 both disclose compressors as described above, in which a pulse damper is inserted in a compressor housing outlet. While this does provide several benefits, the disclosed pulse damper still has some disadvantages. In particular, the disclosed pulse damper is generally D-shaped in cross section with the flat side being received against a portion of the compressor housing. Thus, there is only flow over this pulse damper for approximately 180°. Also, the outer periphery of this pulse damper is smooth and has no flow directing means. Lastly, this pulse damper passes through the valve plate of the compressor, but there is a substantial clearance between the pulse damper and the valve plate. Since there is only flow over 180°, there is no flow directing means, and there is a relatively large clearance between the valve plate and the pulse damper, the flow from one fluid passage is not directed into the flow from the other fluid passage such that pulses in the two flows are substantially reduced.

It is therefore an object of the present invention to disclose an improved pulsation damper that is simple to manufacture, relatively inexpensive and useful as a retro-fit into existing compressors.

SUMMARY OF THE INVENTION

A pulsation damper as disclosed by the present invention is received within the outlet of a pressure fluid system and is disposed at the junction of two discharge pressure lines.

The pulsation damper of the present invention consists of a cast body portion and a cast cap portion that is received upon the body portion. The body portion has groove-like outer passages formed at an outer periphery and which conduct fluid from one of the discharge lines rearwardly along the body back into the other discharge line. These passages are undercut portions extending radially inwardly from the outer periphery of the body. The passages are spaced circumferentially about the entire outer periphery and are separated by lands that define the body outer periphery. Also, these passages only extend from an intermediate point on the body rearwardly to the rear end of the body. The forward end of the body, beyond this intermediate point, does not have these undercut passages. This aids in conducting the fluid rearwardly.

The pulse damper preferably passes through an opening in the valve plate, and is tightly received in the opening, such that grooves in the outer periphery of the pulse damper from the only flow passage from the second discharge line rearwardly back into the first discharge line.

These outer passages conduct the fluid in a direction opposite to the fluid in the first discharge line. The pulse within the two discharge pressure lines will, at any moment, tend to be relatively equal. That is, since each of the pistons in an opposed piston arrangements, one of which is illustrated at 24 and 26, may discharge at the same time, the pressure in lines 32 and 34 may be relatively equal at any given moment. These equal pressure pulses will be brought into contact with each other from opposite directions and will be lessened. A central passage extends through the body of the pulsation damper and conducts the fluid from both the first and second discharge lines through the pulsation damper body and through outlets that are formed in the cap. The cap is formed with several small outlet ports arranged circumferentially spaced from each other and the fluid is conducted out through one of these small outlet ports. Bending the fluid through the tortuous path necessary for it to reach an outlet port eliminates the majority of the pulsations. The resulting flow is relatively quiet.

The cap is dimensioned to have an outer diameter equal to or slightly smaller than the outlet opening in a standard compressor. Thus, this pulsation damper may be used as a retro-fit into existing compressors.

In a second embodiment, the cap has a dome that creates a space that will further eliminate pulsations by providing a plenum.

In a third embodiment, the damper is a one piece item having a relatively large diameter shoulder portion which is received in the compressor housing in a relatively smaller body portion which includes the flow passages. In this embodiment, the enlarged shoulder portion, which is formed integrally with the remainder of the body portion, is the portion that secures the pulse damper in the compressor housing.

A fourth embodiment of the present invention includes a separate cap member having a dome creating a plenum to reduce pulses, in which the dome includes radially outwardly extending passages which conduct the fluid from within the pulse damper into the outlet line of the compressor.

The pulsation damper of the present invention can be utilized in any fluid pressure system where two high pressure lines are mixed into a single outlet.

When used in an air conditioning compressor, this pulse damper reduces the pulsations such that they approximate the "valve rattle noise" which is unavoidalbe. This resulting noise appears to have a higher frequency sounding more like a constant hum than drum-like.

Further objects and features of the present invention can be best understood from the following specification and appended drawings, the following of which is a brief description thereof.

BRIEF DESCRIPTION OF THE DRAWINGS

FIG. 1 is a cross-sectional view, largely schematic, through a prior art compressor assembly.

FIG. 2 is a graph showing a typical pressure curve for the prior art compressor of FIG. 1.

FIG. 3 is an enlarged view of a portion of the cross-section illustrated in FIG. 1, but incorporating the pulsation damper of the present invention.

DETAILED DESCRIPTION OF THE PREFERRED EMBODIMENT

Figure 4:
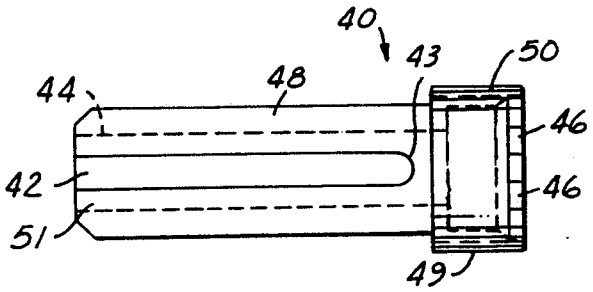
FIG. 4 is a side view of a first embodiment of the pulsation damper of the present invention.

A first embodiment of the pulsation damper of the present invention can be best understood from FIG. 3–8. As illustrated in FIG. 3, pulsation damper 40 is disposed in an outlet 36 that combines two fluid discharge lines 32 and 34. It is to be understood that these two fluid discharge lines could lead from any pressure fluid source, such as the compressor assembly 20 illustrated in FIG. 1. Pulsation damper 40 extends generally along an axis from a rear position to a forward position, defined as left-to-right in FIG. 3. The pulsation damper 40 has several groove-like outer passages 42 that conduct fluid rearwardly from an intermediate point 43 along the length of pulsation damper 40 from second discharge line 34 to line 35 and first discharge line 32. A central passage 44 extends forwardly throughout the axial length of the pulsation damper 40 and conducts fluid from both the first and second discharge lines forwardly through pulsation damper 40 and outwardly through outlets 46.

Pulsation damper 40 has body portion 48 arranged generally coaxially relative to cap portion 50 with a holding portion 49 that is dimensioned to be capable of being press fit into the opening 37 that forms part of outlet 36. Thus, pulsation damper 40 will be tightly received within the outlet 36 of the housing 21 of the compressor assembly 20 to ensure adequate seal. This prevents fluid in line 34 from moving forwardly between opening 37 and cap 50. It should also be noted that the pulsation damper 40 is received within the boundaries of the housing 21 and does not extend outside of housing 21 to add to the overall size of compressor assembly 20.

There is a radial clearance between housing 21 and body portion 48 that allows fluid from line 34 to pass circumferentially about the entire outer periphery of body 48 and communicate with each of the passages 42. Thus, fluid flows over 360° of the body. Body portion 48 is tightly received in an opening in the valve plate, and all flow is directed through passages 42.

FIG. 4 illustrates pulsation damper 40 consisting of body portion 48, outer passages 42, cap portion 50, central passage 44, and outlets 46 in cap 50. Outer passages 42 are shown as not extending to the forwardmost extent of body portions 48, but only to intermediate point 43. As can be seen from FIGS. 3 and 6, groove-like passages 42 are undercut radially inwardly from the outer periphery of body 48. Lands 51 circumferentially alternate with passages 42 and define the outer periphery of a portion of body 48.

Figure 5:
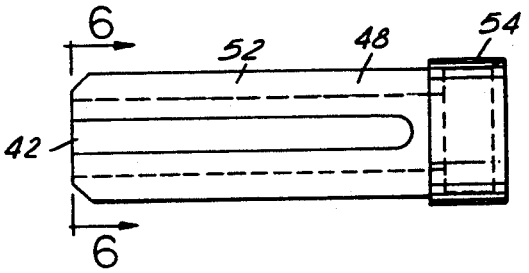
FIG. 5 is a side view of the body portion of the pulsation damper.

FIG. 5 illustrates body 48 of pulsation damper 40 which consists of shank portion 52 having 42 and head portion 54.

Figure 6:
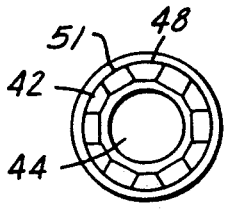
FIG. 6 is a end view along lines 6—6 as illustrated in FIG. 5.

FIG. 6 illustrates an end view of body 48 and shows how outer passages 42 circumferentially alternate with lands 51. It should be understood that there will be unimpeded flow from second discharge line 34 through passages 42 rearwardly along body 48 and into line 35. Thus, the grooved configuration of pulsation damper 40 ensures that the pulsating fluid flow from line 34 will be directed axially rearwardly along passages 42 to oppose and blend with the pulsating flow from passage 32, thereby causing the pulsations to be lessened.

Figure 7:
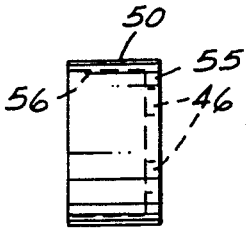
FIG. 7 is a side view of the cap portion of the pulsation damper.

FIG. 7 illustrates cap 50 being cup-shaped and having an open end defining an inner bore 56 to receive head 54 of body 48. Passages 46 are shown in a closed face 55 of cap 50 opposite the open end. Bore 56 is dimensioned to be capable of being press fit onto head 54.

Figure 8:
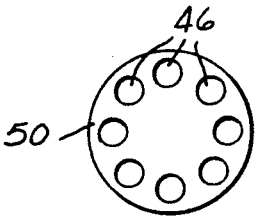
FIG. 8 is an end view of the cap portion illustrated in FIG. 7.

FIG. 8 illustrates and end view of cap 50 and shows several circumferentially spaced outlet ports 46.

As should be understood from the drawings, shank portions 52 has a first outer diameter and head portion 54 has a second outer diameter that is greater than this first diameter. The diameter of bore 44 is less than the inner diameter of head portion 54, causing additional turbulence and blending of the fluid flows as they enter head portion 54.

Figure 9:
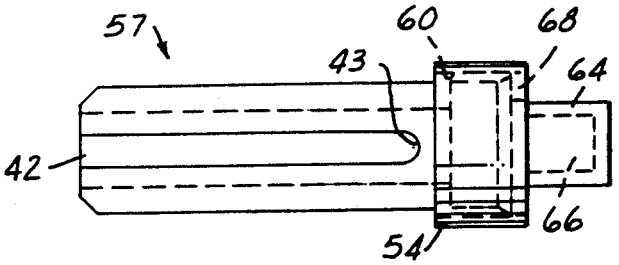
FIG. 9 is a side view of a second embodiment of the pulsation damper.
Figure 10:
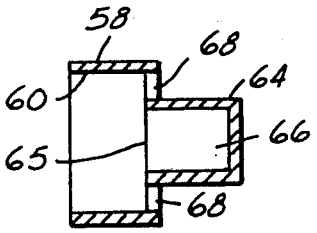
FIG. 10 is a cross-sectional view of the cap portion of the second embodiment.
Figure 11:
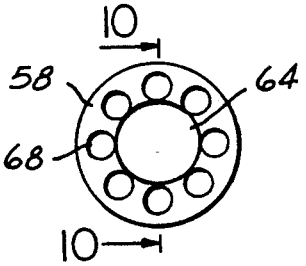
FIG. 11 is an end view of the cap portion illustrated in FIG. 10.

A second embodiment 57 of the pulsation damper is illustrated in FIGS. 9–11. Cap 58 of the second embodiment 57 consists of an inner bore 60 that receives the head portion 54 of body 48. A dome 64 is disclosed at the forward end of cap 58. Passage 65 provides communication from bore 60 into a plenum or space 66 within dome 64. Plenum 66 functions to further eliminate any pulsation that reach cap 58. Exit passages 68 are spaced circumferentially and radially outwardly from dome 64.

Figure 12:
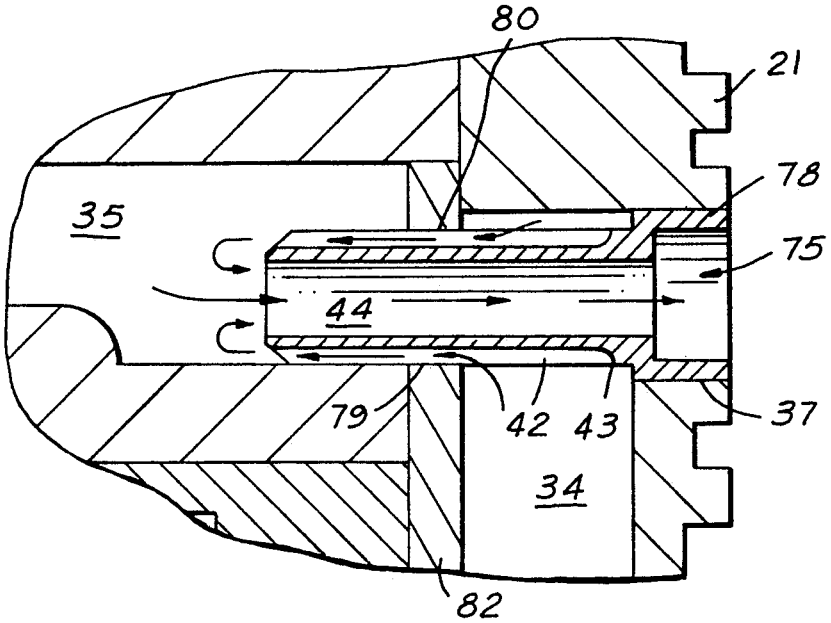
FIG. 12 is a view similar to FIG. 3, but showing a third embodiment of the pulsation damper.

A third embodiment pulsation damper 75 is illustrated in FIG. 12 and includes a one piece cast body having shoulder portions 78 which is of a diameter approximately equal to opening 37 in compressor housing 21. Grooves 42 are formed in a body portion 79 similar to the first two embodiments. Body portion 79 is generally coaxial to shoulder portion 78, ensuring that there will be flow through 360°. As with the first two embodiments, flow from second discharge line 34 passes rearwardly to line 35, where the two fluid flows are intermixed. They then both travel through passage 43 to the outlet of the compressor.

Body portion 79 is received within an opening 80 in valve plate 82. The diameter of body portion 79 is approximately equal to the inner diameter of opening 80 such that pulses damper 75 is tightly received in valve plate 82. As shown, all flow from second discharge line 34 to line 35 must pass through grooves 42.

It is also envisioned that the grooves which create the flow passage may be formed in valve plate 82 rather than in the pulse damper. That is, since the pulse damper 75 is tightly received in valve plate 82, it would be possible to have flow passages 42 formed in valve plate 82 rather than in pulse damper 75. The passages could be broached into the valve plate. Also, the compressor housing 21 could be integrally cast to include a pulse damper.

Figure 13:
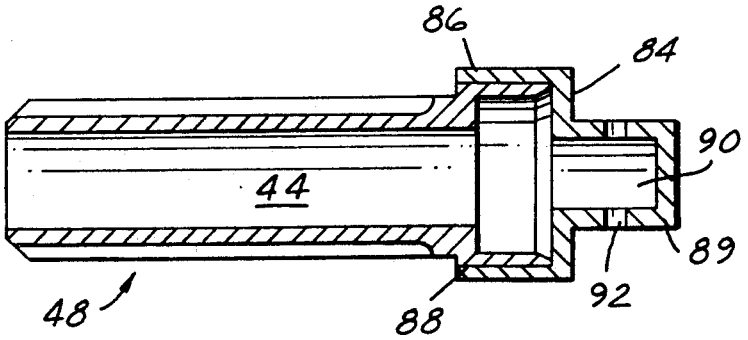
FIG. 13 is a cross-section view of a fourth embodiment of the pulsation damper.

A fourth embodiment pulsation damper 84 is illustrated in FIG. 13. Pulsation damper 84 includes portion 48 which is similar to the body portion in the first two embodiments. Pulsation damper 84 includes cap 86 having inner diameter 88 perceived on body portion 48. Dome 89 creates a plenum 90, similar to that of the second embodiment illustrated in FIG. 9. Flow outlet passages 92 pass radially outwardly of dome 89 and fluid flows from passage 44 radially outwardly through passages 92 to the outlet of the compressor. Now the operation of the present invention will be disclosed with reference to the drawings. A pulsation damper such as damper 40 is tightly received in an outlet line 36 that connects two fluids discharge lines 32 and 34. Fluid flow from line 34 is deflected rearwardly along passages 42 and is brought into opposition with fluid from line 32. The fluids mix and return forwardly through central passage 44 and then outwardly through ports 46 formed in the forward end of cap 50. The opposition and blending of the two main fluid flow streams, coupled with the tortuous path the fluid must follow to get from lines 32 and 34 to outlets 46, serves to substantially reduce the amplitude of the pressure pulses that are present in the fluid as it leaves the compressor cylinders.

In a preferred embodiment the body and cap portions are formed as cast items.

Also, the holding portion 49 and the overall axial length of pulsation damper 40 are selected such that pulsation damper 40 will be tightly received within standard compressor housings. Thus, the pulsation damper 40 may be used as a retro-fit item.

The pulse damper may also be slip-fit into the outlet and captured within the housing by the hose leading to the condenser.

Preferred embodiments of the present invention have been disclosed, however, certain modifications would be obvious to one of ordinary skill in the art and thus the following claims should be reviewed in order to determine the true scope of the present invention.

I claim:

1. A pulsation damper comprising a shoulder portion of a first relatively large diameter, and having a body portion extending coaxially away from said shoulder portion, said body portion being of a second diameter smaller than said first diameter;

said body portion and said shoulder being integrally cast members, said shoulder having an outer diameter that is designed to approximate the inner diameter of the outlet of a compressor housing.

2. A pulse damper as recited in claim 1, wherein there are flow passages at the outer periphery of said body portion, and said body portion and said shoulder portion both being hollow.

3. A pulse damper as recited in claim 1, wherein said second diameter being selected to approximate the size of an opening in a valve plate of a compressor.

4. A pulse damper as recited in claim 3, wherein there are flow passages at the outer periphery of said body portion, and said body portion and said shoulder portion both being hollow.

5. In a fluid system comprising a compressor mounted in a housing and containing multiple sources of pressurized fluid flow, first and second sub-sets of such sources supplying pressurized fluid to first and second internal passages respectively within the housing, said first and second internal passages communicating with a housing outlet port, an improved pulsation damper provided therein:

damper means dimensioned and shaped to be insertable into the housing through said outlet port and to be retained within said outlet port with substantially all of said damper means being located within the housing, said damper means having a securing section received in said outlet and a body portion extending coaxially from said securing portion.

6. The fluid system of claim 5, wherein said damper means has fluid flow directing means configured so that fluid from said second internal passage is free to flow over the entire outer periphery of said body in a direction generally opposite to the direction of fluid flow in said first internal passage and to cause said oppositely directed fluid flows to meet while still travelling in generally opposite directions and to thereafter blend and flow together through said hollow body and out said outlet port.

7. A fluid system as recited in claim 5, wherein said body portion and said securing section are integrally formed.

8. The fluid system of claim 7, wherein said damper means having fluid flow directing means configured to direct fluid from said second internal passage along an exterior of said body portion in a direction generally opposite to the direction of fluid flow in said first internal passage and to cause said oppositely directed fluid flows to meet while still travelling in generally opposite directions and to thereafter blend and flow together through said body portion and out said outlet port.

9. The fluid system of claim 5, wherein said body portion hollow and open at a first end and said securing portion a cap portion is disposed at the opposite end of said body portion, said cap portion being shaped and dimensioned to seat within said outlet port to thereby locate and secure said damper means within the housing, said cap portion having outlet means communicating with said open end of said hollow body portion and with the housing exterior, whereby fluid flowing in said first and second internal passages enters said first end of said hollow body portion and flows through said body and cap portions and through said outlet means.

10. The fluid system of claim 9, wherein said cap portion has a hollow bore with a first internal diameter adjacent to and in communication with said hollow body portion, said cap portion further having a closed-ended chamber communicating with said hollow bore and having a second internal diameter less that said first internal diameter, said closed end of said chamber being located at the end of said damper means which is remote from said first end of said hollow body portion, an annular shoulder defining the transition between said first and second internal diameters, and said outlet means comprising a series of outlet openings extending radially outwardly through said closed-ended chamber, whereby said closed-ended chamber functions to generate turbulent fluid flow to enhance the pulsation dampening action of said damper means.

11. The fluid system of claim 10, wherein said damper means has fluid flowing directing means configured so that fluid from said second internal passage is free to flow over the entire outer periphery of said body in a direction generally opposite to the direction of fluid flow in said first internal passage and to cause said oppositely directed fluid flows to meet while still travelling in generally opposite directions and to thereafter blend and flow together through said hollow body and out said outlet port.

* * * * *